United States Patent [19]

Shortte, Jr.

[11] 4,224,884

[45] Sep. 30, 1980

[54] TUFTING MACHINE

[75] Inventor: Willard H. Shortte, Jr., La Grange, Ga.

[73] Assignee: Milliken Research Corporation, Spartanburg, S.C.

[21] Appl. No.: 938,027

[22] Filed: Aug. 30, 1978

[51] Int. Cl.[2] ..... D05C 15/00

[52] U.S. Cl. ..... 112/79 R

[58] Field of Search ..... 112/79 A, 79 R, 79 KF

[56] References Cited

U.S. PATENT DOCUMENTS

| | | | |
|---|---|---|---|
| 2,679,218 | 5/1954 | Jones | 112/79 R |
| 3,100,465 | 8/1963 | Broadrick | 112/79 R |
| 3,100,466 | 8/1963 | Ledford et al. | 112/79 R |
| 3,203,388 | 8/1965 | Parlin et al. | 112/410 |
| 3,220,371 | 11/1965 | Short et al. | 112/266 |
| 3,393,658 | 7/1968 | Barnes | 112/79 R |
| 3,440,983 | 4/1969 | Woodcock | 112/79 R |
| 3,577,943 | 5/1971 | Watkins | 112/79 R |
| 3,585,948 | 6/1971 | Cobble | 112/79 R |
| 3,964,408 | 6/1976 | Smith | 112/79 A |
| 4,100,863 | 7/1978 | Shortte | 112/79 R |

*Primary Examiner*—Ronald Feldbaum

*Attorney, Agent, or Firm*—Earle R. Marden; H. William Petry

[57] ABSTRACT

A tufting machine which employs at least one row of tufting needles and a pin roll in the needle plate to control transverse movement of the backing material. The pin roll impales the incoming backing material to be tufted and is shifted laterally one-half gauge for each reciprocation of the needle bar to eliminate the roving effect of the tufted yarn in the tufted fabric being produced.

2 Claims, 4 Drawing Figures

TUFTING MACHINE

Prior to this invention, tufted fabric tended to have an unpleasant appearance due to the rowing effect of the loops of yarn tufted into the fabric. This effect was very noticeable in upholstery fabric when the fabric was bent around the arm or back of a chair or sofa which tended to separate the loops and expose the backing material.

Therefore, it is an object of the invention to provide a tufted fabric which reduces the rowing effect of the yarn loops tufted into the fabric.

Other objects and advantages of the invention will become readily apparent as the specification proceeds to describe the invention with reference to the accompanying drawings, in which.

Figure 1:
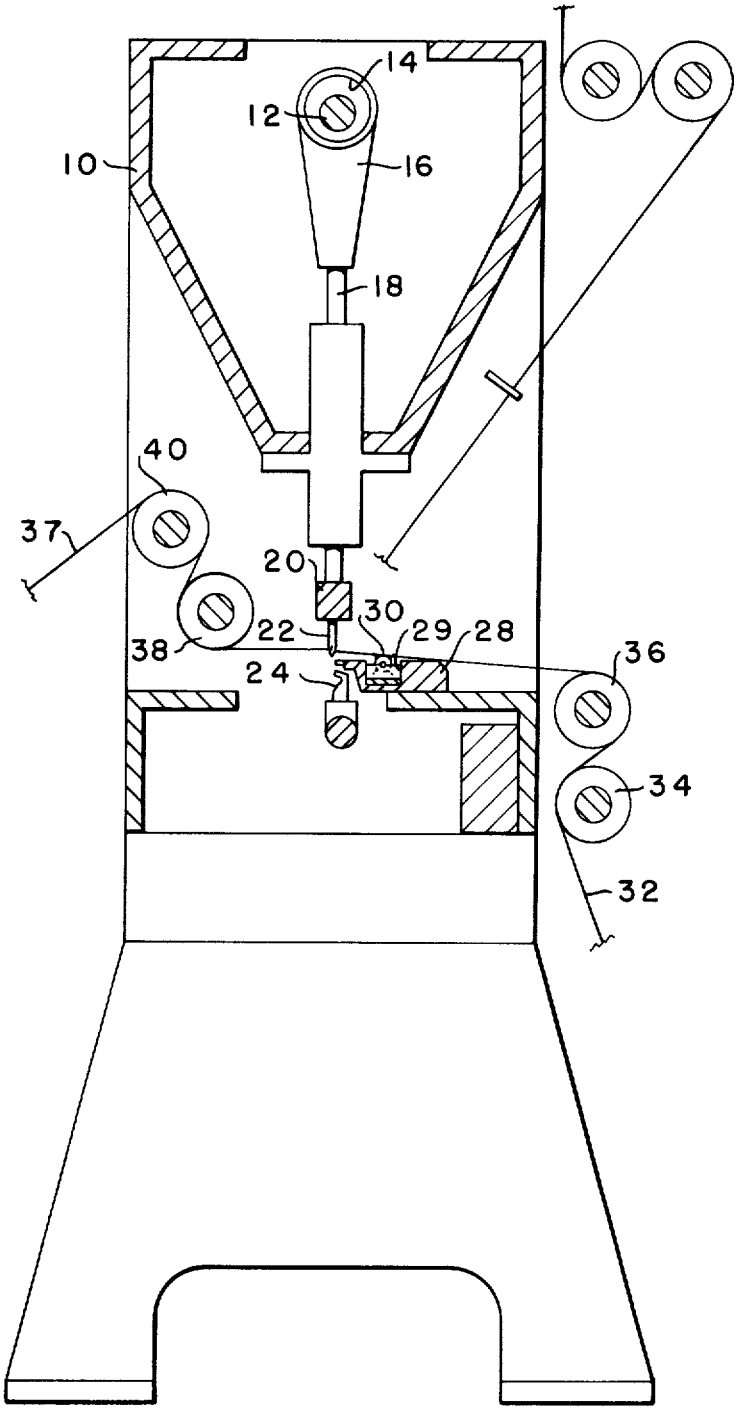
FIG. 1 is a sectional view of a needle type tufting machine equipped with a mechanism to shift the backing material.
Figure 2:
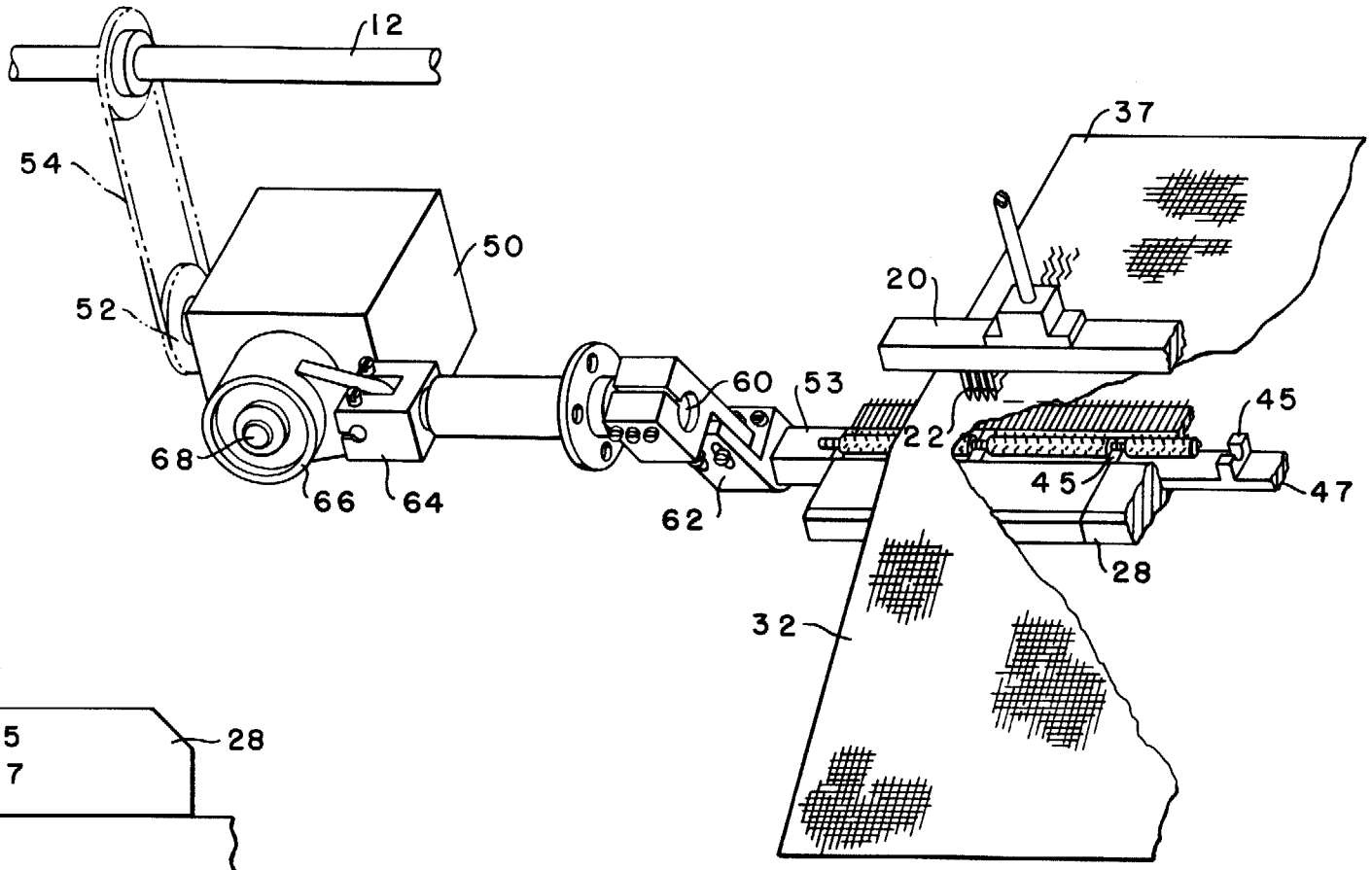
FIG. 2 is a blown up perspective view of the drive and shifting mechanism.
Figure 4:
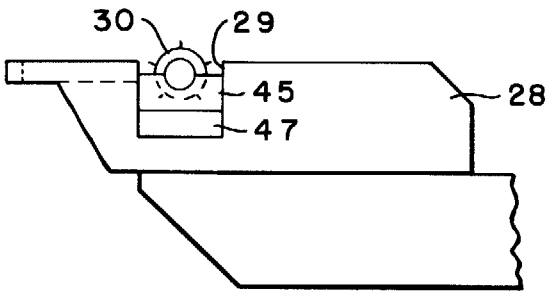
FIG. 4 is an end view of the pin roll in the needle plate.
Figure 3:
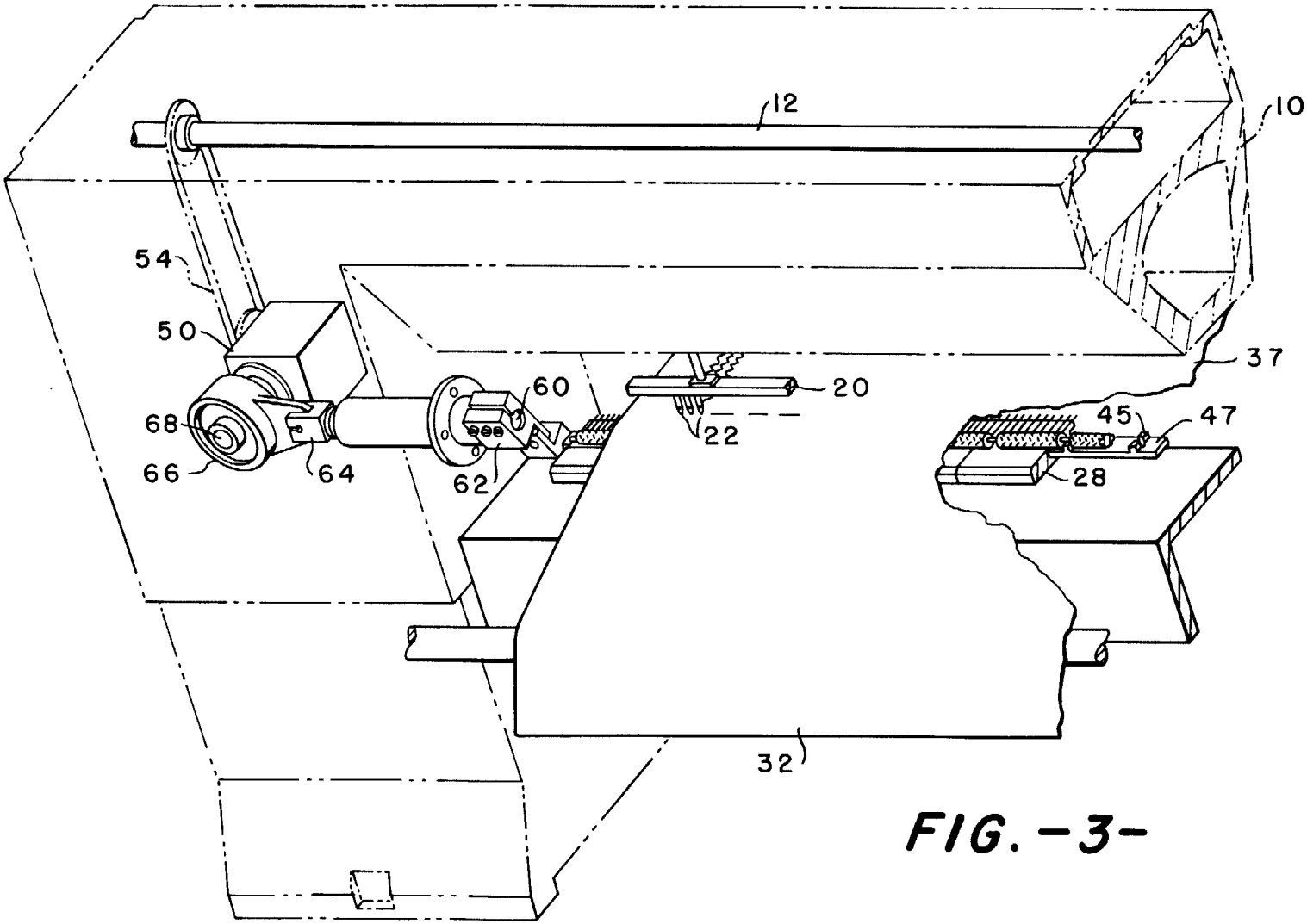
FIG. 3 is a blown up perspective view of the backing material, pin roll and tufting needles.

Looking now to FIG. 1, the reference numeral 10 represents the frame 10 of a conventional tufting machine on which is supported the usual tufting machine elements such as the crankshaft 12, the eccentric 14, connecting rod 16, the needle bar push rod 18, the needle bar 20, a row of tufting needles 22 with cooperating loopers 24 and the needle plate 28 in which is slidably mounted in groove 29, the pin rolls 30. The needle plate has a plurality of spacers 31 thereon to accommodate therebetween the tufting needles 22.

In operation, the backing material 32 to be tufted is delivered into the tufting machine by front feed rolls 34 and 36 over the pin rolls 30 wherein it is tufted by the conventional action of the needles 22 and loopers 24. Then the tufted fabric 37 is delivered to a take-up roll or folding device (not shown) by the back feed rolls 38 and 40 which are driven in synchronism with each other.

As discussed briefly before, the tufted loops tend to line up in rows in the longitudinal direction of the fabric creating undesirable effects and therefore, a mechanism has been provided to move the backing fabric relative to the rows of needles upon each reciprocation of the needle bar to break up the appearance of having the tufted loops in a row. Preferably, but not necessarily mandatory, the backing fabric is moved laterally one-half gauge upon one reciprocation of the needle bar and back one-half gauge on the next reciprocation of the needle bar. This will provide a zig zag pattern of the tufted loops to provide the appearance of a double gauge fabric.

This movement of the backing material 32 is accomplished by lateral movement of the pin rolls 30 which impale the backing material. Pin rolls 30 are idler rolls which are rotatably mounted in bearing blocks 45 mounted on sliding plate 47. To slide the plate 47 and the pin rolls 30 mounted thereon a right angle gear box 50, driven by sprocket 52 connected to the main drive shaft 12 by suitable drive chain 54, is employed. The pin rolls are fixed to the plate 47 which is connected to the push rod 53 and is moved back and forth by the connecting rod 60 supported in the connector 62. The connecting rod 60 is driven by the connector 64 connected to the eccentric cam 66 mounted on the output shaft 68 of the gear box 50.

As discussed briefly before, it is desired to shift the backing material one-half a guage for each reciprocation of the needle bar which is equivalent to one rotation of the drive shaft 12. Therefore, in the desired form of the invention, the gear box 50 is selected to provide a 2-1 gear reduction so that upon one rotation of the shaft 12 the rolls 30 will be slid in one direction and will be returned to the starting position on the next complete rotation of the shaft 12. Obviously, other proportions of movement of the rolls can be obtained by different selection of gear ratios for the gear box 50. These selections, of course, depend on the selected aesthetic valve desired in the tufted product.

It can readily be seen that the herein disclosed apparatus provides a tufting machine in which the tufted loops in the product are moved out of position relative to adjacent tufted loops to break up the effect of rowing in the product.

Although the preferred embodiment of the invention has been described, it is contemplated that changes may be made without departing from the scope or spirit of the invention and it is desired that the invention be limited only by the claims. z That which is claimed is:

1. Apparatus to produce a tufted pile fabric comprising: a frame, a needle bar mounted on said frame, a needle plate mounted under said needle bar having spaces therein to accommodate a plurality of needles, a row of needles mounted on said needle bar, a first means to reciprocate said needle bar, a pair of feed rolls supplying backing material into operative relationship with said row of needles over said needle plate, an elongated transverse groove in said needle plate between said needle bar and said pair of feed rolls, a plate member slidably mounted in said groove, a plurality of bearing blocks mounted on said plate member, pin roll means mounted in said bearing blocks to engage the backing material supplied to said row of needles and means operably associated with said plate member to slide said plate member laterally back and forth of said row of needles to adjust the position of the backing material relative to said row of needles.

2. The apparatus of claim 1 wherein said plate member is slid to move the backing material one-half a gauge upon each reciprocation of said needle bar.

* * * * *